US007079128B2

(12) United States Patent
Kim

(10) Patent No.: US 7,079,128 B2
(45) Date of Patent: Jul. 18, 2006

(54) METHOD OF AND SYSTEM FOR AUTOMATICALLY SETTING DISPLAY MODE OF MONITOR, AND RECORDING MEDIUM PERFORMING THE SAME

(75) Inventor: Kook-won Kim, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 224 days.

(21) Appl. No.: 10/101,281

(22) Filed: Mar. 20, 2002

(65) Prior Publication Data

US 2002/0135605 A1 Sep. 26, 2002

(30) Foreign Application Priority Data

Mar. 20, 2001 (KR) ..... 10-2001-0014360

(51) Int. Cl.
*G09G 5/00* (2006.01)

(52) U.S. Cl. ..... 345/213; 345/699

(58) Field of Classification Search ..... 345/204, 345/211, 212–214, 699, 698
See application file for complete search history.

(56) References Cited

U.S. PATENT DOCUMENTS

| | | | | |
|---|---|---|---|---|
| 5,375,210 | A * | 12/1994 | Monnes et al. | 710/10 |
| 6,043,814 | A * | 3/2000 | Lim | 345/700 |
| 6,049,316 | A * | 4/2000 | Nolan et al. | 345/698 |
| 6,115,026 | A * | 9/2000 | Spurlock | 345/24 |
| 2001/0004257 | A1* | 6/2001 | Nitta et al. | 345/211 |

FOREIGN PATENT DOCUMENTS

| | | | |
|---|---|---|---|
| CN | 087118043 | | 10/1998 |
| JP | 9-298703 | | 11/1997 |
| JP | 11-102278 | | 4/1999 |
| JP | 11-231994 | * | 8/1999 |
| JP | 11-85121 | | 3/2000 |
| JP | 2000-194346 | | 7/2000 |
| KR | 1998-4756 | | 3/1998 |
| KR | 1999-0055689 | | 7/1999 |

OTHER PUBLICATIONS

Korean Office Action for Korean Application No. 10-2001-0014360 with English Abstract.
Taiwanese Office Action for Related Application.
Office Action Issued by State Intellectual Property Office of the People's Republic of China Sep. 9, 2005.

* cited by examiner

*Primary Examiner*—Alexander Eisen
(74) *Attorney, Agent, or Firm*—Staas & Halsey LLP

(57) ABSTRACT

A display mode auto-setting method for a monitor displaying a video signal received from a video card includes reading a display information provided in the monitor, reading a plurality of display modes from the video card, selecting one of the display modes equal to the display information by comparing the display information with the display modes, and outputting the video signal based on the selected display mode to the monitor. A system for automatically setting a display mode of a monitor, in which the monitor is optimized, automatically selects the display mode most approximate to optimum display information of the monitor among the display modes supported by the video card.

64 Claims, 4 Drawing Sheets

METHOD OF AND SYSTEM FOR AUTOMATICALLY SETTING DISPLAY MODE OF MONITOR, AND RECORDING MEDIUM PERFORMING THE SAME

CROSS-REFERENCE TO RELATED APPLICATIONS

This application claims the benefit of Korean No. 2001-14360, filed Mar. 20, 2001, in the Korean Industrial Property office, the disclosure of which is incorporated herein by reference.

BACKGROUND OF THE INVENTION

1. Field of the Invention

The present invention relates in general to a monitor, and more particularly, to a method of and a system for automatically setting a display mode of a monitor, and a recording medium having a display mode setting program.

2. Description of the Related Art

A monitor is a display apparatus outputting a video signal transmitted from a signal source, such as a computer, etc., thereon. The monitor is provided with an electrically erasable programmable read only memory (EEPROM) storing enhanced display information data (EDID) containing a model number necessary for a monitor driver of the computer system to recognize the monitor, the kind of applicable resolution, and the resolution recommended by a monitor vendor, etc.

When the monitor is installed in a computer system, the monitor driver adapted to the monitor is automatically or manually detected. In the case of the automatic detection, the computer reads the EDID from the EEPROM of the monitor through a display data channel (DDC) when an operating system having a plug and play (PnP) function boots up the computer system.

After the monitor driver is detected, a user can set a display mode of the monitor with the monitor driver on the basis of the resolution, a frequency, etc., supported by a video card of the computer system.

However, the user generally knows little information on the resolution, colors, etc., supported by the video card, and therefore it is difficult for the user to optimize the display mode of the monitor. Thus, the user cannot use maximum capabilities of the monitor and the video card.

Further, when the monitor is replaced with a new one, if the existing display mode is applied to the new monitor because it is difficult for the user to set a new display mode for the new monitor, a screen of the monitor flickers or has a low quality because the existing display mode may be not adapted to the new monitor.

SUMMARY OF THE INVENTION

Accordingly, the present invention has been made keeping in mind the above-described shortcomings and needs of a user, and an object of the present invention is to provide a method and a system for automatically setting a display mode of a monitor, and a recording medium having a display mode setting program, in which the monitor is optimized by automatically selecting an optimum display mode among a plurality of display modes supported by a video card.

Additional objects and advantageous of the invention will be set forth in part in the description which follows and, in part, will be obvious from the description, or may be learned by practice of the invention.

These and other objects of the present invention may be accomplished by a display mode auto-setting method for a monitor displaying a video signal received from a video card, the display mode auto-setting method comprising reading display information provided in the monitor, reading a plurality of display modes from the video card, selecting one of the display modes equal to the display information by comparing the display information with the display modes, and outputting a video signal based on the selected display mode to the monitor.

The selecting of the one of the display modes includes selecting the one of the display modes most approximate to the display information when there are no display modes equal to the display information.

The display information includes resolution based on timing information, and the selecting further includes selecting the one of the display modes having a combination of the number of horizontal and vertical pixels smaller than that of the display information.

The display information further includes a vertical frequency based on timing information, and the selecting includes selecting the one of the display modes having a combination of the number of the horizontal and vertical pixels and the vertical frequency smaller than that of the display information, and selecting the one of the display modes when the one is a minimum sum among the sums calculated by equivalently converting differences between the display information and the display modes in the number of the horizontal and vertical pixels and the vertical frequency.

The display mode auto-setting method further comprises determining whether to automatically set an optimum display mode of the monitor with the selected display mode, and selecting manually the display mode adapted to the monitor when the auto-setting of the optimum display mode is not selected.

According to another embodiment of the present invention, the above and other objects may be also achieved by the provision of a display mode auto-setting system for a monitor displaying a video signal received from a video card, the display mode auto-setting system comprising a reader part reading display information from the monitor and a plurality of display modes from the video card and a comparing and selecting part comparing the display information with the plurality of display modes and selecting one of the display modes selected by the comparison for a display mode of the monitor.

The comparing and selecting part selects the one of the display modes equal to the display information among the display modes by comparing the display information with the display modes.

The comparing and selecting part selects the one of the display modes most approximate to the display information by comparing the display information with the display modes.

The display mode auto-setting system further comprises a selection part determining whether to automatically set the optimum display mode of the monitor with the display mode selected by the comparing and selecting part, and manually setting the display mode of the monitor.

The display information includes resolution based on timing information, and the comparing and selecting part selects the one of the display modes having a combination of the number of horizontal and vertical pixels smaller than that of the display information.

The display information further includes a vertical frequency based on the timing information, and the comparing and selecting part selects the display mode having a combination of the number of the horizontal and vertical pixels and the vertical frequency smaller than that of the display information, and selects the one of a plurality of display modes when the one is a minimum sum among sums calculated by equivalently converting differences between the display information and the display modes in the number of the horizontal and vertical pixels and the vertical frequency.

According to another embodiment of the present invention, the above and other objects may be also achieved by the provision of a computer-readable recording medium on which a display mode auto-setting program for a monitor displaying a video signal received from a video card is recorded, wherein the program executes procedures of reading display information provided in the monitor, reading a plurality of display modes from the video card, selecting one of the display modes equal to the display information by comparing the display information with the display modes, and outputting the video signal based on the selected display mode to the monitor.

BRIEF DESCRIPTION OF THE DRAWINGS

These and other objects and advantages will become apparent and more readily appreciated from the following description of the preferred embodiments, taken in conjunction with the accompanying drawings of which.

DETAILED DESCRIPTION OF THE PREFERRED EMBODIMENTS

Figure 1:
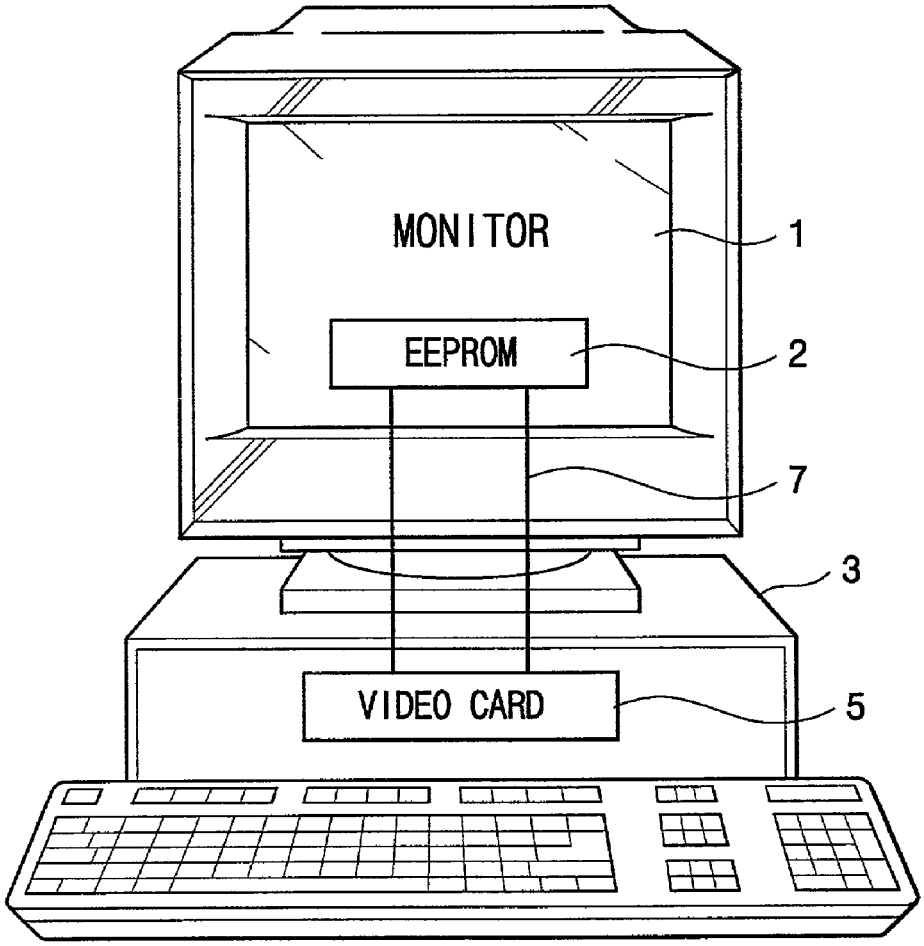
FIG. 1 illustrates a computer system according to an embodiment of the present invention, in which a display mode of a monitor is set automatically.

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

The present invention will be described in more detail with reference to the accompanying drawings.

FIG. 1 illustrates a computer system according to an embodiment of the present invention, for automatically setting a display mode of a monitor. As shown therein, the computer system comprises a main body 3 provided with a video card 5, and a monitor 1 displaying a video signal received from the video card 5 thereon. The monitor 1 and the main body 3 are connected with a display data channel (DDC) line 7 for a DDC, through which the monitor 1 transmits information for setting the monitor 1, such as horizontal and vertical frequencies, etc., to the main body 3, and the main body 3 transmits a control signal to the monitor 1. Herein, the DDC recognizing a Plug and play (PnP) function of the monitor 1 is employed for communication between the monitor 1 and the video card 5 of the main body 3.

Further, the monitor 1 is provided with an EEPROM 2 storing enhanced display information data (EDID), so that the main body 3 reads the EDID from the EEPROM 2 when the monitor 1 is installed in the computer system.

Herein, the EDID contains information relating to the monitor 1, such as a model number, color coordinates, the kind of applicable resolution, horizontal and vertical frequencies, a color bit, and so on.

Figure 2:
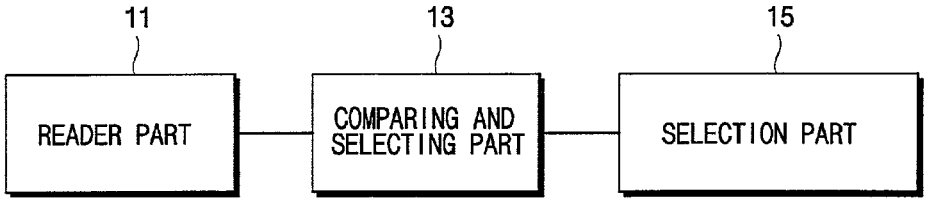
FIG. 2 is a control block diagram of a display mode auto-setting system for the monitor of FIG. 1.

FIG. 2 is a control block diagram of a display mode auto-setting system of the monitor according to the present invention.

In the present embodiment, the display mode auto-setting system is accomplished by providing a software program stored in a monitor driver installation diskette provided by a monitor vendor. As shown therein, the display mode auto-setting system comprises a reader part 11 and a comparing and selecting part 13. The reader part 11 reads the EDID from the EEPROM 2 and a plurality of display modes from the video card 5. The comparing and selecting part 13 compares optimum display information of the EDID with the display modes read by the reader part 11, and sets an optimum display mode of the monitor 1 on the basis of one of the display modes of the video card 5 most approximate to the optimum display information of the EDID.

Herein, the optimum display information of the EDID preferably contains the resolution defined as a combination of the number of horizontal and vertical pixels and a vertical frequency based on timing information. Each of the display modes of the video card 5 contains the resolution, a vertical frequency, etc., for setting the display mode adapted to the monitor 1.

The comparing and selecting part 13 compares the resolution and the vertical frequency according to the optimum display mode of the monitor 1 with every resolution and every vertical frequency provided in the plurality of display modes of the video card 5, and calculates a sum of a difference between the resolution and a difference between the vertical frequencies. Then, the comparing and selecting part 13 selects one of the display modes of the video card 5 in the case that the one is a minimum sum among the sums of the differences for the optimum display mode. Thus, the comparing and selecting part 13 outputs a video signal based on the selected display mode of the video card 5 to the monitor 1, thereby optimizing a screen of the monitor 1.

The display mode auto-setting system further comprises a selection part 15 determining whether to automatically set the display mode of the monitor 1 with the selected display mode by the comparing and selecting part 13 in an auto-setting mode or to manually set the display mode of the monitor 1 in a manual-setting mode. The selection part 15 produces a display setting window on a screen of the monitor 1, thereby enabling a user to set the display mode adapted to the monitor 1 manually when the user selects the manual-setting mode.

With this configuration, the display mode auto-setting system controls the video card 5 to output the video signal adapted to the optimum display mode of the monitor 1 to the monitor 1.

Figure 3:
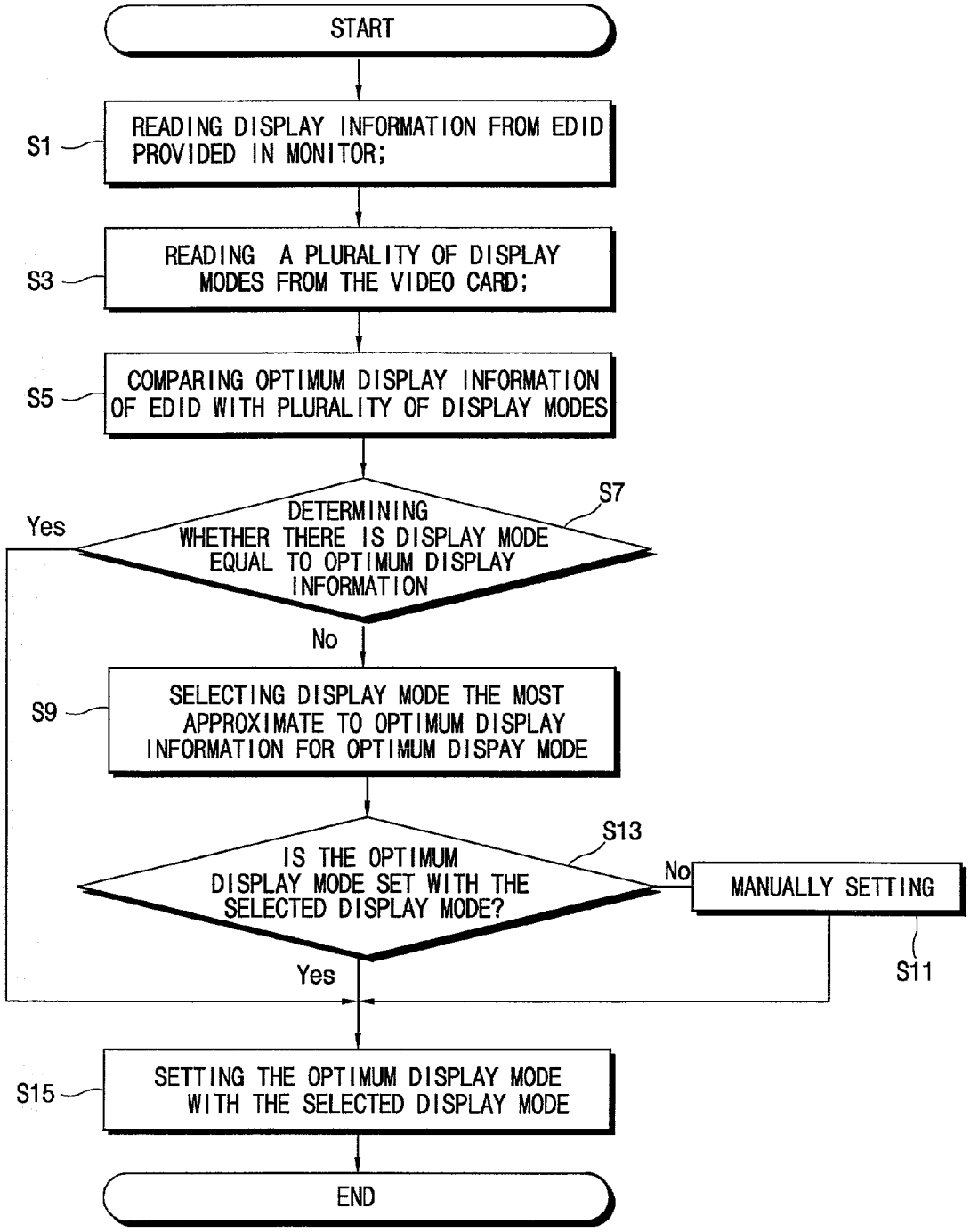
FIG. 3 is a flow chart illustrating a display mode auto-setting method according to the display mode auto-setting system of FIG. 2.
Figure 4:
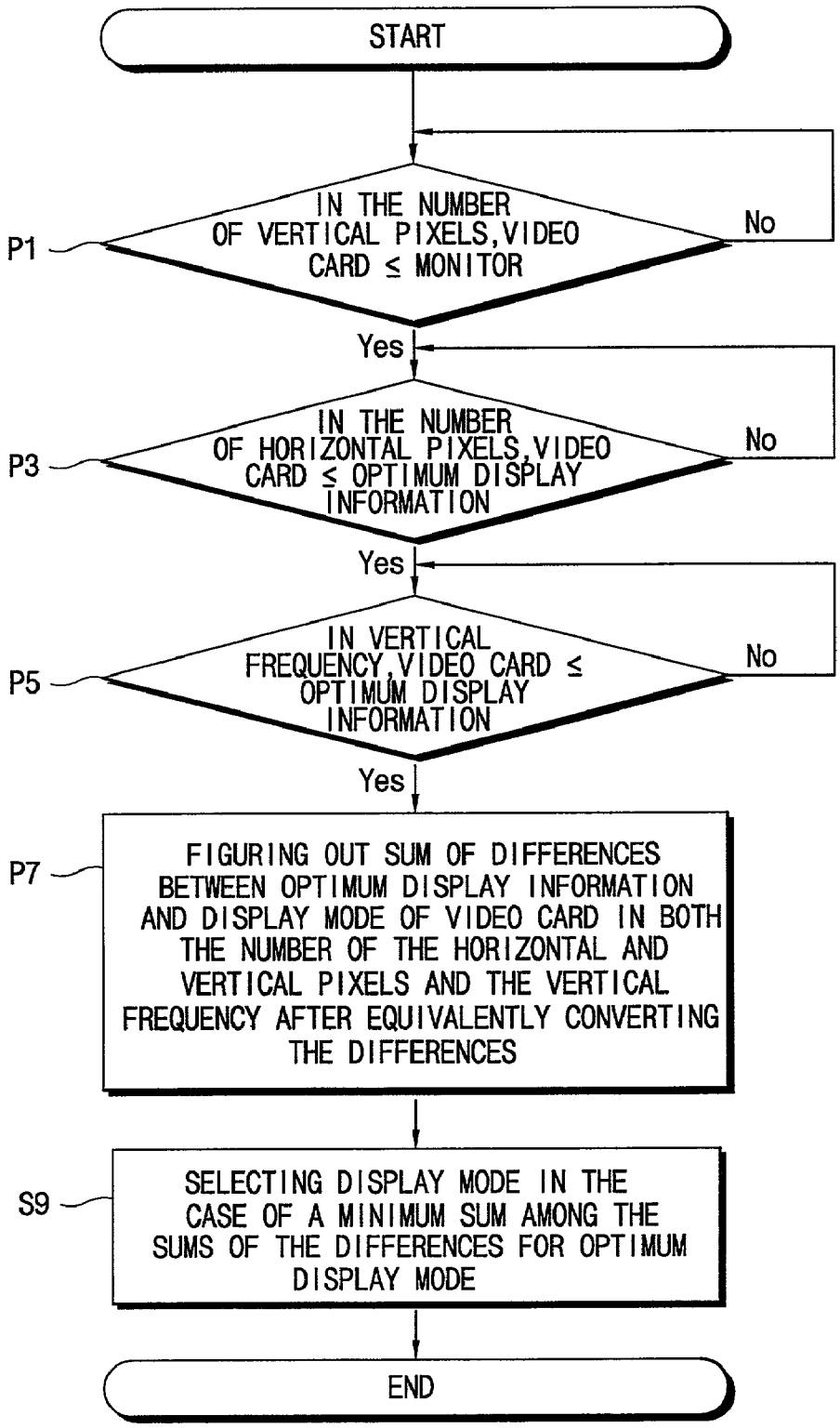
FIG. 4 is a detailed flow chart illustrating the display mode auto-setting method of FIG. 3.

FIG. 3 is a flow chart illustrating a display mode auto-setting method according to the system of FIG. 2, and FIG. 4 is a detailed flow chart illustrating the display mode auto-setting method of FIG. 3.

Hereinafter, the display mode auto-setting method according to the present invention will be described referring to FIG. 3. Here, before setting the display mode, a monitor driver installation program is executed so as to detect a monitor driver adapted to the monitor 1 by reading the EDID from the EEPROM 2, and installs the monitor driver.

First, the reader part 11 reads a resolution (a combination of horizontal and vertical pixels) and a vertical frequency according to the optimum display information from the EDID stored in the EEPROM 2 of the monitor 2 in operation S1, and reads a plurality of resolutions (a combination of horizontal and vertical pixels) and a plurality of vertical frequencies according to the display modes supported by the video card 5 from the video card 5 in operation S3. Then, the comparing and selecting part 13 compares the optimum display information of the EDID with the display modes of the video card 5 in operation S5, and determines whether there is a display mode equal to the optimum display information in operation S7. When there is a display mode equal to the optimum display information, the comparing and selecting part 13 selects the display mode of the video card 5 for the optimum display mode in operation S15. When there are no display modes equal to the optimum display information, the comparing and selecting part 13 selects one of the display modes of the video card 5 most approximate to the optimum display information of the EDID for the optimum display mode in operation S9.

Hereinafter, the process of selecting the display mode of the video card 5, which is most approximate to the optimum display information of the EDID operation S9 in FIG. 3, will be described referring to FIG. 4. First, the optimum display information is compared with every display mode of the video card 5 in regard with the number of vertical pixels in operation P1. Then, the display mode of the video card 5 smaller than the optimum display information in regard with the number of vertical pixels is compared with the optimum display information in the horizontal pixels in operation P3. Then, the display mode of video card 5 smaller than the optimum display mode in regard with the number of both vertical and horizontal pixels is compared with the optimum display information in a vertical frequency in operation P5. In the case that the optimum display information of the monitor 1 is larger than the display mode of the video card 5 in both the number of horizontal and vertical pixels and the vertical frequency, differences between the optimum display information and the display mode of the video card 5 in regard with both the number of the horizontal and vertical pixels and the vertical frequency are equivalently converted, and the sum thereof is calculated in operation P7. Then, the display mode of the video card 5 in the case of a minimum sum among the sums of the differences is selected as the optimum display mode in operation P9.

Where the optimum display information includes variables X, Y, and Z indicating the number of the horizontal pixels, the number of vertical pixels, and the vertical frequency, respectively, and where the display mode includes variables X', Y', and Z', the sum is calculated using a formula of SUM=IX−X'I+IY−Y'I+a*IZ−Z'I, wherein "a" is a constant.

After the display mode of the video card 5 which is the most approximate to the optimum display information is selected as the optimum display mode, as shown in FIG. 3, the selection part 15 lets the user determine whether to automatically set the optimum display mode of the monitor 1 with the display mode selected by the above comparison or to manually set the display mode adapted to the monitor 1 in operation S13. If the user selects the auto-setting mode, the optimum display mode of the monitor is automatically set with the selected display mode in operation S15, so that the video card 5 outputs a video signal adapted to the optimum display mode of the monitor 1 to the monitor 1. Oppositely, if the user selects the manual-setting mode, the user can manually set the resolution, the frequency, etc., of the monitor 1 in operation S11.

With this configuration, the present invention provides a monitor which is optimized by automatically selecting a display mode most approximate to an optimum display mode of the monitor among a plurality of display modes supported by a video card.

In the above embodiment, the display mode auto-setting method proceeds sequentially after installing the monitor driver. However, the display mode auto-setting method may proceed under conditions that the monitor driver is already installed.

In the above embodiment, differences between the optimum display information of the monitor and a display mode of the video card in vertical and horizontal pixels and frequencies is equivalently converted, and the sum thereof is figured out. However, various mathematical methods may be employed for figuring out the difference, the sum, etc.

The display mode auto-setting system for a monitor according to the present invention may be stored in a recoding medium such as an installation diskette, CD-ROM and so on.

As described above, the present invention provides a method and a system for automatically setting a display mode of a monitor, in which the monitor is optimized by automatically selecting a display mode which is the most approximate to an optimum display information of the monitor among a plurality of display modes supported by a video card.

Although a few preferred embodiments of the present invention have been shown and described, it would be appreciated those skilled in the art changes may be made in this embodiment without departing from the principles and sprit of the invention, the scope of which is defined in the claims and equivalents.

What is claimed is:

1. A display mode auto-setting method of a monitor displaying a video signal received from a video card, comprising:

reading specified display parameters of the monitor;

reading a plurality of display modes, respectively, each having a plurality of parameters each corresponding to the specified display parameters of the monitor from the video card;

calculating a plurality of summed differences between the specified display parameters and the corresponding plurality of parameters, respectively for each of the display modes;

selecting one of the display modes which has a minimum sum over all calculated summed differences; and outputting the video signal based on the selected display mode to the monitor.

2. The method of claim 1, wherein the specified display parameters includes a resolution, and the selecting further includes selecting the one of the display modes having a combination of numbers of horizontal and vertical pixels smaller than that of the specified display parameters.

3. The method of claim 2, wherein the specified display parameters further include a vertical frequency, and the selecting further includes selecting the one display mode having a combination of the number of the horizontal and vertical pixels and the vertical frequency smaller than that of the specified display parameters, and selecting the one display mode in a case that the one display mode is the minimum sum among sums calculated according to differences between the specified display parameters and the corresponding parameters of each of the plurality of display modes in the numbers of the horizontal and vertical pixels and the vertical frequency.

4. The method of claim 1, further comprising determining whether to automatically set an optimum display mode of the monitor with the selected display mode, and selecting manually the display mode adapted to the monitor when the auto-setting of the optimum display mode is not selected.

5. A display mode auto-setting system for a monitor displaying a video signal received from a video card, comprising:

a reader part reading specified display parameters from the monitor and a plurality of display modes, respectively, each having a plurality of parameters corresponding to the specified display parameters of the monitor from the video card; and a comparing and selecting part calculating a plurality of summed differences between the specified display parameters and the corresponding plurality of parameters, respectively, for each of the display modes, and selecting one of the display modes which has a minimum sum over all calculated summed differences for an optimum display mode of the monitor.

6. The system of claim 5, wherein the comparing and selecting part selects the one display mode among the plurality of display modes having parameters that are most approximate to the specified display parameters.

7. The system of claim 5, further comprising a selection part determining whether to automatically set the optimum display mode of the monitor with the one display mode selected by the comparing and selecting part, and enabling manual setting of the display mode of the monitor when the auto-setting of the optimum display mode is not selected.

8. The system of claim 5, wherein the specified display parameters include a resolution, and the comparing and selecting part selects the one display mode having a combination of numbers of horizontal and vertical pixels smaller than that of the specified display parameters.

9. The system of claim 8, wherein the specified display parameters further comprises a vertical frequency, and the comparing and selecting part selects the one display mode having the combination of the numbers of the horizontal and vertical pixels and the vertical frequency smaller than that of the specified display parameters and selects the one display mode in a case that the one is the minimum sum among sums calculated according to differences between the specified display parameters and the corresponding parameters of each of the plurality of display modes in the numbers of the horizontal and vertical pixels and the vertical frequency.

10. A computer-readable recording medium on which a display mode auto-setting program for a monitor displaying a video signal received from a video card is recorded, wherein the program executes procedures of:

reading specified display parameters of the monitor, reading a plurality of display modes, respectively, having a plurality of parameters each corresponding to the specified display parameters of the monitor from the video card;

calculating a plurality of summed differences between the specified display parameters and the corresponding plurality of parameters, respectively for each of the display modes;

selecting one of the display modes which has a minimum sum over all calculated summed differences; and outputting the video signal based on the selected display mode to the monitor.

11. The computer-readable recording medium of claim 10, wherein the specified display parameters includes a resolution, and the selecting further includes selecting the one display mode having a combination of numbers of horizontal and vertical pixels smaller than that of the specified display parameters.

12. The computer-readable recording medium of claim 11, wherein the specified display parameters further includes a vertical frequency, and the selecting procedure further includes selecting the one display mode having a combination of the numbers of the horizontal and vertical pixels and the vertical frequency smaller than that of the specified display parameters, and selecting the one display mode when the one display mode is the minimum sum among sums calculated according to differences between the specified display parameters and the corresponding parameters of each of the plurality of display modes in the numbers of the horizontal and vertical pixels and the vertical frequency.

13. The computer-readable recording medium of claim 10, further including a procedure of determining whether to automatically set an optimum display mode of the monitor with the selected display mode, and enabling manual selecting of the optimum display mode adapted to the monitor when the auto-setting of the optimum display mode is not selected.

14. A display mode setting method in a video signal displaying system, comprising:

automatically generating specified display parameters of a monitor and a plurality of display modes, each having a plurality of parameters corresponding to the specified display parameters, relating to a driver for driving a video signal to the monitor; and selecting one of the display modes as an optimized display mode of the monitor based on a plurality of summed differences between the specified display parameters and the corresponding plurality of parameters corresponding, respectively for each of the display modes.

15. The method of claim 14, wherein the driver generates the video signal in accordance with the one selected display mode.

16. The method of claim 14, wherein the monitor is optimized with the one display mode when receiving the video signal and generating an image corresponding to the video signal.

17. The method of claim 14, further comprising receiving the specified display parameters through a display data channel (DDC) line coupled to the monitor.

18. The method of claim 17, further comprising automatically receiving the specified display parameters by using a plug and play operation of the monitor through a DDC of the DDC line when the monitor is connected to the video signal displaying system through the DDC line.

19. The method of claim 17, further comprising:

storing the specified display parameters in a memory disposed within the monitor; and reading the specified display parameters from the memory.

20. The method of claim 19, wherein the memory is connected to the video signal displaying system through the DDC line.

21. The method of claim 19, wherein the memory stores enhanced display information data (EDID) relating to characteristics of the monitor, the EDID including the specified display parameters.

22. The method of claim 21, wherein the EDID includes any combination of a model number, a resolution, a kind of the resolution, a horizontal frequency, a vertical frequency, and a color bit.

23. The method of claim 14, wherein the one display mode has the parameters corresponding to the specified display parameters that are most approximate to the specified display parameters of the monitor.

24. The method of claim 14, wherein the specified display parameters are at least one of a resolution, a vertical frequency and a horizontal frequency.

25. The method of claim 14, wherein the one display mode includes a combination of numbers of horizontal and vertical pixels smaller than that of the specified display parameters.

26. The method of claim 14, wherein the specified display parameters include a vertical frequency and numbers of horizontal and vertical pixels, and the one display mode includes a combination of the numbers of horizontal and vertical pixels and the vertical frequency smaller than that of the specified display parameters.

27. The method of claim 26, wherein the one display mode is a minimum sum among the plurality of summed differences between the specified display parameters and the display modes in terms of the numbers of the horizontal and vertical pixels and the vertical frequency, respectively.

28. The method of claim 14, further comprising selecting one of an auto-setting mode and a manual-setting mode, wherein the one of the display modes is automatically set as the optimum display mode of the monitor when the auto-setting mode is selected.

29. The method of claim 28, further comprising displaying the one display mode when the auto-setting mode is selected.

30. The method of claim 28, wherein the one display mode is manually selected when the manual-setting mode is selected.

31. The method of claim 30, further comprising displaying a display mode setting window on a screen of the monitor when the manual-setting mode is selected.

32. A display mode setting apparatus in a video display system, comprising:

a reading part receiving specified display parameters relating to a monitor and a plurality of display modes, each having a plurality of parameters corresponding to the specified display parameters, relating to a driver for driving a video signal to the monitor, and a comparing and selecting part comparing the plurality of parameters, for each display mode, corresponding to the specified display parameters, with the specified display parameters and selecting one of the display modes as an optimized display mode of the monitor based on a plurality of summed differences between the specified display parameters and the corresponding plurality of parameters, respectively for each of the display modes.

33. The apparatus of claim 32, wherein the driver generates the video signal in accordance with the one display mode.

34. The apparatus of claim 32, further comprising a display data channel (DDC) line transmitting the specified display parameters from the monitor to the reading part.

35. The apparatus of claim 34, wherein the specified display parameters are automatically transmitted to the reading part from the monitor by using a plug and play operation of the monitor through a DDC of the DDC line when the monitor is connected to the video signal displaying system through the DDC line.

36. The apparatus of claim 34, further comprising a memory disposed within the monitor to store the specified display parameters.

37. The apparatus of claim 36, wherein the memory is connected to the video signal displaying system through the DDC line.

38. The apparatus of claim 36, wherein the memory stores enhanced display information data (EDID) relating to characteristics of the monitor, the EDID including the specified display parameters.

39. The apparatus of claim 38, wherein the EDID includes any combination of a model number, a resolution, a kind of the resolution, a horizontal frequency, a vertical frequency and a color bit.

40. The apparatus of claim 32, wherein the one display mode has parameters corresponding to the specified display parameters that are most approximate to the optimum display parameters of the monitor.

41. The apparatus of claim 32, wherein the specified display parameters are at least one of a resolution, a vertical frequency and a horizontal frequency.

42. The apparatus of claim 32, wherein the one display mode includes a combination of numbers of horizontal and vertical pixels smaller than that of the specified display parameters.

43. The apparatus of claim 32, wherein the specified display parameters include a vertical frequency and numbers of horizontal and vertical pixels, and the one display mode includes a combination of the numbers of horizontal and vertical pixels and the vertical frequency smaller than that of the specified display parameters.

44. The apparatus of claim 43, wherein the one of the display modes is a minimum sum among a plurality of summed differences calculated according to differences between the specified display parameters and the display modes in terms of the numbers of the horizontal and vertical pixels and the vertical frequency, respectively.

45. The apparatus of claim 32, wherein the comparing and selecting part enables selection of one of an auto-setting mode and a manual-setting mode, the one display mode being automatically set as an optimum display mode of the monitor when the auto-setting mode is selected.

46. The apparatus of claim 45, wherein the driver generates an image signal corresponding to the one display mode when the auto-setting mode is selected.

47. The apparatus of claim 45, wherein the driver generating a display mode setting window on a screen of the monitor when the manual-setting mode is selected.

48. A computer-readable recording medium, in which a display mode setting program is recorded, wherein the display mode setting program executes procedures of:

reading specified display parameters of a monitor;

reading a plurality of display modes, respectively, each having a plurality of parameters corresponding to the specified display parameters of the monitor of a system; and selecting one of the display modes whose parameters are most approximate to the specified display parameters based on a plurality of summed differences between the specified display parameters and the corresponding plurality of parameters, respectively for each of the display modes.

49. The medium of claim 48, wherein the display mode setting program executes a procedure of generating a video signal to display an image corresponding to the video signal on the monitor in accordance with the one display mode.

50. The medium of claim 48, wherein the display mode setting program executes a procedure of automatically transmitting the specified display parameters from the monitor to the system when the monitor is connected to the system.

51. The medium of claim 48, wherein the display mode setting program executes a procedure of transmitting any combination of a model number, a resolution, a kind of the resolution, a horizontal frequency, a vertical frequency and a color bit from the monitor to the system.

52. The medium of claim 48, wherein the display mode setting program executes a procedure of selecting the one display mode having a combination of numbers of horizontal and vertical pixels smaller than that of the specified display parameters.

53. The medium of claim 48, wherein the display mode setting program executes a procedure of selecting the one display mode having a combination of numbers of horizontal and vertical pixels and a vertical frequency smaller than that of the specified display parameters.

54. The medium of claim 48, wherein the display mode setting program executes a procedure of selecting the one display mode when the one is a minimum sum of all the summed differences between the specified display parameters and the parameters of each of the display modes in numbers of horizontal and vertical pixels and a vertical frequency.

55. The medium of claim 48, wherein the display mode selling program executes a procedure of selecting one of an auto-setting mode and a manual-setting mode, wherein the one display mode is automatically set as an optimum display mode of the monitor wherein the auto-setting mode is selected, and the one display mode is manually selected in the manual-setting mode.

56. A display mode auto-setting method of a monitor displaying a video signal received from a video card, comprising:

reading display information including a display resolution and a display refresh frequency of the monitor;

reading a plurality of display modes, each having parameters corresponding to the display resolution and a display refresh frequency of the monitor, from the video card;

comparing the display information with the display modes, and selecting one of the display modes which has a minimized sum of summed differences between the display resolution of the monitor and a corresponding display resolution parameter, for each of the display modes, and of the display refresh frequency of the monitor and a corresponding display refresh frequency parameter, for each of the display modes; and outputting the video signal based on the selected display mode to the monitor.

57. A display apparatus, comprising:

a memory to store display information data including specified display parameters for the display apparatus;

a reader to read out the specified display parameters from the memory to a video source, separate from the display apparatus;

a video input to receive a video signal from the video source, the video signal being generated based on a selected display mode data of a plurality of display mode data, each of the video source; and wherein the selected display mode data is based on a minimum difference calculation using the read out specified display parameters when the specified display parameters are not equal to any of the plurality of display mode data of the video source.

58. The display apparatus of claim 57, wherein the plurality of display mode data have a plurality of respective parameters corresponding to the specified display parameters, and wherein the selected display mode data is selected by calculating a plurality of summed difference between the specified display parameters and corresponding plurality of parameters for each of the plurality of display mode data and selecting one display mode data, of the plurality of display mode data, which has a minimum sum over all calculated summed differences.

59. The difference apparatus of claim 58, wherein the specified display parameters include a resolution, and the selecting of the selected display mode data further comprises selecting the one display mode data having a combination of numbers of horizontal and vertical pixels smaller than that of the specified display parameters.

60. The apparatus of claim 59, wherein the specified display parameters further comprise a vertical frequency, and the selecting of the selected display mode data further comprises selecting the one display mode data having a combination of the number of the horizontal and vertical pixels and a vertical frequency smaller than the vertical frequency of the specified display parameters, and selecting the one display mode data when the one display mode is the minimum sum among sums calculated according to differences between the specified display parameters and the corresponding parameters of each of the plurality of display modes in the numbers of the horizontal and vertical pixels and vertical frequency.

61. The display apparatus of claim 57, wherein the selected display mode data is the one display mode data among the plurality of display mode data having parameters that are most approximate for the specified display parameters.

62. The display apparatus of claim 57, wherein the reader comprises a display data channel.

63. The display apparatus of claim 57, wherein the memory comprises at least one of a model number, a resolution, a kind of resolution, a horizontal frequency, and a color bit.

64. The display apparatus of claim 57, wherein the video source is a video card.

* * * * *

UNITED STATES PATENT AND TRADEMARK OFFICE

CERTIFICATE OF CORRECTION

PATENT NO. : 7,079,128 B2
APPLICATION NO. : 10/101281
DATED : July 18, 2006
INVENTOR(S) : Kook-won Kim It is certified that error appears in the above-identified patent and that said Letters Patent is hereby corrected as shown below:

Column 7, Line 55, change “monitor,” to --monitor;--.

Column 9, Line 48, change “monitor,” to --monitor;--.

Column 11, Line 30, change “selling” to --setting--.

Signed and Sealed this

Twenty-sixth Day of December, 2006

JON W. DUDAS
*Director of the United States Patent and Trademark Office*